United States Patent [19]

Michaels

[11] Patent Number: 5,040,260

[45] Date of Patent: Aug. 20, 1991

[54] TOOTH CLEANING AND POLISHING DEVICE

[76] Inventor: George G. Michaels, 384 Stevick Dr., Atherton, Calif. 94025

[21] Appl. No.: 324,479

[22] Filed: Mar. 16, 1989

[51] Int. Cl.[5] ..... A46B 9/04

[52] U.S. Cl. ..... 15/167.1; 15/159 A; 15/188; 128/62 A

[58] Field of Search ..... 15/110, 159 A, 167.1, 15/167.3, 186, 187, 188; 128/62 A; D4/104, 105, 106, 107; D24/36

[56] References Cited

U.S. PATENT DOCUMENTS

| | | | |
|---|---|---|---|
| 1,327,757 | 1/1920 | Eggers | 15/188 |
| 2,042,239 | 5/1936 | Planding | 15/167.1 |
| 2,206,726 | 7/1940 | Lasater | 15/110 |
| 2,225,331 | 12/1940 | Campbell | 15/167.1 |
| 2,279,355 | 4/1942 | Wilensky | 15/188 |
| 2,545,814 | 3/1951 | Kempster . | |
| 3,007,441 | 11/1961 | Eyer | 15/167.1 |
| 3,103,027 | 9/1963 | Birch . | |
| 3,359,588 | 12/1967 | Kobler . | |
| 3,553,759 | 9/1968 | Kramer et al. | 15/188 |
| 3,840,932 | 10/1974 | Balamuth et al. . | |
| 4,081,877 | 4/1978 | Vitale . | |
| 4,128,910 | 12/1978 | Nakata et al. . | |
| 4,167,794 | 9/1979 | Pomeroy | 15/159 A |
| 4,263,691 | 4/1981 | Pakarnseree | 15/167.1 |
| 4,646,381 | 3/1987 | Weihrauch | 15/167 |
| 4,691,404 | 9/1987 | Tarrson et al. | 15/167.1 |
| 4,776,358 | 10/1988 | Lorch . | |

FOREIGN PATENT DOCUMENTS

| | | | |
|---|---|---|---|
| 840347 | 1/1939 | France | 15/187 |
| 401903 | 5/1966 | Switzerland | 15/159 A |
| 788 | of 1861 | United Kingdom | 15/188 |
| 134983 | 11/1919 | United Kingdom | 15/167.1 |

OTHER PUBLICATIONS

"Jordan V" photocopied photos dated 2-2-89.

*Primary Examiner*—Philip R. Coe
*Assistant Examiner*—Mark Spisich
*Attorney, Agent, or Firm*—Townsend and Townsend

[57] ABSTRACT

A toothbrush head which is effective for cleaning and polishing teeth and massaging and stimulating the gums, without injury to hard and soft tissue and is durable. The head includes a plurality of integral projections parallel to each other and extending outwardly from a pad. Each projection is constructed of a thermoplastic elastomer providing a high coefficient of friction between the projections and tooth enamel and cementum. The tip and side surfaces of the projections have substantially identical coefficients of friction between the respective surfaces and the tooth's enamel/cementum. At least a portion of the plurality of projections have beveled edges. The projections having beveled edges are preferably arranged in pairs. Each projection of each pair has a beveled edge oriented so as to be positioned in facing relationship with the other projection of the pair. The pairs are configured as facing truncated cylinders. A lip surrounds the perimeter of the head and serves as a bumper in order to protect the gums during brushing.

7 Claims, 1 Drawing Sheet

TOOTH CLEANING AND POLISHING DEVICE

BACKGROUND OF THE INVENTION

1. Field of the Invention

This invention relates to a durable toothbrush head which is effective for cleaning and polishing teeth, and massaging and stimulating the gums, without injury to the hard or soft tissues.

Conventional toothbrushes with nylon bristles have been used since the 1940's. Despite manufacturer's numerous attempts to improve nylon bristles, they continue to exhibit the same disadvantages as conventional toothbrushes. These disadvantages include: (1) rapid permanent deformation (matting and tapering of the bristles) of the brushing structure resulting in inefficient cleaning and limited toothbrush life: (2) poor polishing (inadequate coefficient of friction and surface area): (3) abrasion to hard and soft tissues: and (4) difficulty in cleaning and drying bristles and tuft retention apertures resulting in compromised hygiene and consequent bacterial/fungal growth.

A person generally uses his or her toothbrush for up to six months. However, for many brush heads, the effect of permanent deformation is manifest by a drop in the ability to remove plaque after only about three weeks of use. In areas where the tooth surface becomes more difficult to reach, such as lingual surfaces, the loss of effectiveness is greater. Both bristle matting and bristle tapering substantially reduce the ability of the brush to remove plaque. Studies have shown that toothbrushes with considerable wear were 50–100% less effective in removing plaque than new toothbrushes. Brush conditions deteriorate with length of use; however, length of use is not determinative in the amount of matting and tapering present. A brush resistant to matting would have markedly superior durability.

Studies have shown that thermoplastic elastomers manifest a polishing of enamel and cementum while the nylon head tends to track on the enamel and cementum and scratch the surface of the tooth. Additionally, thermoplastic elastomeric materials are resistant to fatigue, and thus, to bristle matting and tapering.

One study found that the only successful method for sterilization of a toothbrush is heating in a microwave oven. However, this method distorts nylon bristles so that it is not feasible for a nylon toothbrush.

DESCRIPTION OF THE PRIOR ART

U.S. Pat. No. 4,128,910 to Nakata discloses a toothbrush designed for children. The brushing structure includes projections having a variety of configurations. The projections are constructed of a thermoset synthetic rubber, specifically, cis-1,4-polyisoprene.

Toothbrush bristles such as disclosed by Nakata are constructed of thermoset materials. Thermoset materials are those which require the addition of ingredients such as fillers, extruders, oils, polymers and stabilizers. After mixing, the resulting batch is formed into a specific shape. The vulcanization process then occurs, resulting in a molded brushing structure ready for mounting on the toothbrush handle. Vulcanization is the crosslinking of the molecular structure. The process in which thermoset products are manufactured is time consuming, labor intensive, and susceptible to a level of quality that varies between lots. It is also a process that offers limited design flexibility due to the poor dimensional tolerances that can be achieved.

U.S. Pat. No. 3,840,932 to Balamuth et al. discloses an electric toothbrush having nylon bristles. The material selected is an acoustically efficient plastic material with a low speed of sound, and thus, low speed of longitudinal vibration. Cleaning of teeth is achieved after positioning bristles on the tooth surface because of the amplitude of vibration of the bristle clusters. Only the tips of the bristles clean the tooth surfaces. These tips are designed to approximate the curvature of the teeth. The bristles are crimped or curly and have a spring-back action. A thermoset material, closed cell rubber, is used to impede high frequency vibrations. Hence, an elastomeric material could not replace the nylon bristles for Balamuth et al.

U.S. Pat. No. 3,359,588 to Kobler discloses a massaging head mounted to a toothbrush handle. An opening is formed in the head for retaining the handle in place. The head is constructed of a slightly resilient thermoset material which encases the entire head portion of the handle. Thus, the resilient material located on the back of the toothbrush head creates a drag on the mucosal tissues, such as the cheek, resulting in discomfort and possible tissue irritation.

Other toothbrush heads have been constructed of various plastic materials. For example, a styrenic block copolymer, has been used in one toothbrush head. While thermoplastics offer flexibility of use, the most desirable materials are those which offer physical properties like a thermoset rubber, while having the cost advantages, and flexibility and adaptability of thermoplastics manufacture. A toothbrush head constructed of a styrenic block copolymer retains a film or residual oil which does not allow efficient cleaning and polishing of the tooth enamel and cementum. The oil acts as a lubricant, and reduces the coefficient of friction between the bristle and the surface of the enamel and cementum, which results in a product that offers inefficient cleaning and polishing performance.

The coefficient of friction is a unitless value (ratio) and is calculated by measuring a series of forces to slide one material across another. In order to be an effective polisher, a well designed geometry must be complemented with a material which has a high coefficient of friction. A styrenic block copolymer, having a high oil level, will not offer a high level of performance, because of its low coefficient of friction.

Various configurations for bristle clusters have been attempted. For example, the bristle clusters may incorporate bristles of varying lengths to achieve a slanted upper edge. In this configuration, the shorter bristles are less flexible and, therefore, less adaptable to conform to the curvature of the tooth.

SUMMARY OF THE INVENTION

The present invention relates to a durable toothbrush head which is effective for cleaning and polishing teeth, without injury to the hard or soft tissue. The head is designed to additionally massage, stimulate and protect the gums.

The configuration of the brushing structure includes a plurality of integral projections, rather than conventional bristle clusters. Unlike conventional clusters, the integral projections comprise only a single element. The projections are constructed of a thermoplastic elastomeric compound which has physical properties similar to rubber.

A plurality of projections are aligned parallel to each other and extend perpendicularly outwardly from a pad or support surface of the toothbrush head. At least a portion of the plurality of projections have beveled edges. The projections having beveled edges are preferably arranged in pairs. Each projection of each pair has a beveled edge oriented so as to be positioned in facing relationship with the other projection of the pair. The pairs are configured as facing truncated cylinders. In the preferred embodiment, a portion of the plurality of projections have a conical configuration. The beveled projections are positioned in rows toward the center of the pad. The conical projections are arranged in a row located adjacent the rows of beveled projections, along the edge of the head.

A lip, also a thermoplastic elastomer, surrounds the perimeter of the head and acts as a bumper for protecting the gums.

The projections are constructed of a thermoplastic elastomer preferably an elastomeric alloy, such as Santoprene ®. Thermoplastic elastomers exhibit the beneficial physical properties of both thermoset rubbers and thermoplastic materials. Thermoplastic elastomers are soft and flexible, like the thermoset rubbers, while including the cost, design and processing advantages of thermoplastics.

A thermoplastic elastomer of the elastomeric alloy type will not produce a lubricant on the surface, hence, the coefficient of friction between the bristle and the tooth enamel/cementum will be greater than that of a styrenic block copolymer and similar to that of a thermoset rubber. In the preferred embodiment, the thermoplastic elastomer selected for construction of the projection provides a high coefficient of friction between the projection and the tooth enamel/cementum. The coefficient of friction of the projection tip surface and the side surfaces is substantially the same. The thermoplastic elastomeric manufacturing process and the material used in this invention are distinct from the manufacturing process and the materials used in thermoset manufacture. The material employed in the present invention offers improved economics, superior quality, consistent performance, and significantly greater design flexibility, i.e., improved dimensional tolerances, in comparison to a thermoset product. The mixing and vulcanization steps of the manufacturing operation are eliminated when the thermoplastic elastomer technology of the present invention is used. Thermoplastic elastomers also allow for the use of materials that are compatible with other thermoplastics. For example, it is possible to bond the thermoplastic elastomeric alloy head to a rigid thermoplastic handle during the injection molding process. This results in further improvement of manufacturing efficiencies. Thus, thermoset materials are less desirable to use than the thermoplastics employed by the present invention.

Thermoplastic elastomeric projections are an improvement over nylon heads because they allow superior cleaning and polishing of the tooth enamel and cementum. Thermoplastic elastomeric projections are less abrasive than nylon bristle clusters, offer higher fatigue resistance, longer head integrity and increased hygienic maintenance. Additionally, with thermoplastic elastomeric projections it is possible to polish the teeth without use of a dentifice.

A highly polished tooth surface provides a cosmetic effect, and also reduces the surface accumulation and retention of bacteria. Supragingival (above the gum) bacteria can cause tooth decay while subgingival (below the gum) bacteria can cause gum disease. Studies have shown that subgingival flora is dependent on the supragingival plaque for its source and perpetuation of organisms.

DETAILED DESCRIPTION OF THE PREFERRED EMBODIMENT

Figure 1:
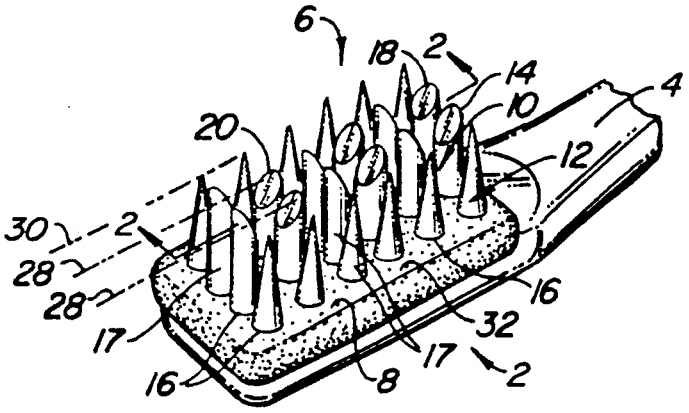
FIG. 1 is a perspective view of the toothbrush head of the present invention.

A toothbrush head 2 incorporating the features of the present invention is illustrated in FIGS. 1–5. Head 2 is formed integral with a handle 4 of a tooth brush. Brushing structure 6 for cleaning and polishing teeth 36 is disposed on head 2.

Brushing structure 6 includes a pad or support surface 8 having projections 10, 12 extending perpendicularly outwardly from pad 8. Each of projections 10, 12 is an integral member disposed substantially parallel to the other projections. Projections 10, 12 have a circular end 16 formed with pad 8, side surfaces 17 extending outwardly from end 16 and terminating at a free end or tip 18. Circular ends 16 of projections 10 and circular ends 16 of projections 12 have approximately the same cross-sectional shape.

Figure 2:
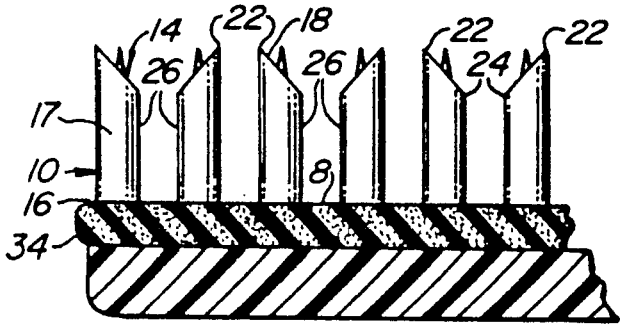
FIG. 2 is a side view of the apparatus of FIG. 1.
Figure 3:
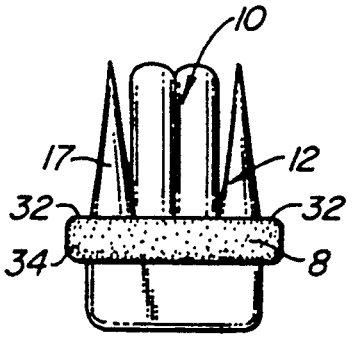
FIG. 3 is an end view of the apparatus of FIG. 1.

Projections 10 constitute a first set of projections formed as facing truncated cylinders. Free ends of projections 10 include a beveled edge 14. Each beveled edge 14 includes a perimeter 20 having an upper rim portion 22 and a lower rim portion 24. Projections 10 are arranged as pairs 26 and oriented such that lower rim portions 24 are positioned to be in facing relationship with each other, as seen in FIG. 2. Upper rim portions 22 of adjacent pairs 26 are in back to back relationship with each other, as seen in FIG. 2.

Projections 12 constitute a second set of projections, each having a conical configuration. Free ends or tips 18 of projections 12 have a pointed configuration.

As most clearly seen in FIG. 1, there are two rows 28 of pairs 26 of projections 10 positioned toward the longitudinal center of pad 8. The two rows 28 are juxtaposed such that upper rim portions 22 of beveled edges 14 of adjacent rows 28 are in side-by-side relation. Lower rim portions 24 of adjacent rows 28 are also in side-by-side relation. Rows 28 extend substantially the length of pad 8. A single row 30 of projections 12 is positioned on outer longitudinal edges 32 of pad 8. Thus, two rows 28 of beveled edge projections 10 are disposed in the center of pad 8, surrounded on either side by a single row 30 of conical projections 12.

A lip 34 disposed on outer edge 32 of pad 8 extends beyond handle 4. Lip 34 serves as a bumper in order to protect the gums during brushing.

Projections 10, 12, pad 8 and lip 34 are constructed of a thermoplastic elastomer. Thermoplastic elastomers demonstrate the attributes of thermoset rubber, i.e., being soft and flexible, while also featuring cost and processing advantages of thermoplastics. The thermoplastic elastomers chosen for head 2 provide a high coefficient of friction between projections 10. 12 and the enamel and cementum of teeth 36. Most effective are the elastomeric alloys, such as Santoprene®. Tip surfaces 18 and side surfaces 17 of projections 10, 12, have substantially identical coefficients of friction between their respective surfaces and the tooth enamel and cementum.

Figure 4:
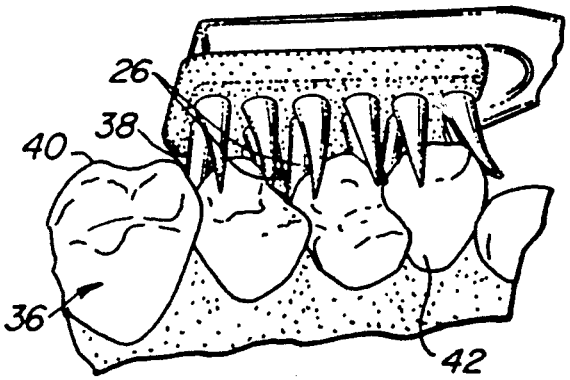
FIG. 4 is a perspective view of the apparatus of FIG. 1 shown in use.
Figure 5:
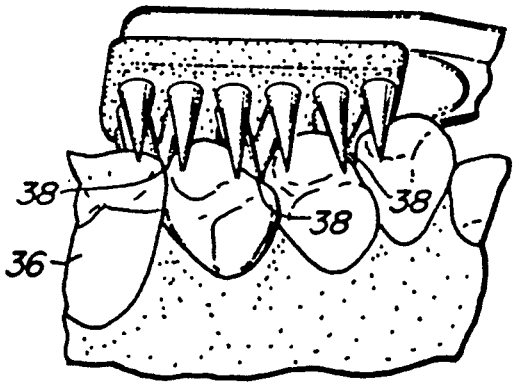
FIG. 5 is a perspective view of the apparatus of FIG. 1 shown in use.

In operation, the user holds handle 4, operating head 2 as a conventional toothbrush. The integral projection system of brushing structure 6 adapts closely to tooth and gum morphology. Projections 10, 12 are deformable at any location along an axis of the projections, including a mid-section, as seen in FIGS. 4 and 5. Thus, side surfaces 17 are adaptable for contacting side surfaces of adjacent projections to cooperatively clean and polish the tooth enamel and cementum.

Because of the flexibility of projections 10, 12, when in the diverging position as seen in FIG. 4, pairs 26 of projections 10 form a glove-like configuration around facial surface 40 of teeth 36. Beveled projections 10 also form a glove-like configuration around lingual surfaces 42 of teeth 36, (configuration not shown). In the converging position of pairs 26 as seen in FIG. 5, projections 10 penetrate the interproximal areas 38 of teeth 36. In the converging position as seen in FIG. 4, upper rim portions 22 of adjacent pairs 26 form a bi-beveled configuration to penetrate interproximal areas 38. Parallel projections 10 clean and polish facial and lingual surfaces 40, 42, respectively, when brushing structure 6 is used in a horizontal direction. During use, conical projections 12 penetrate under the gums (sulcus) and into the crevices of teeth 36 (occlusal surfaces).

Thermoplastic elastomers provide an optimum coefficient of friction between the projection and the tooth enamel and cementum. Because of the selected thermoplastic elastomeric material, brushing structure 6 may be used with or without a dentifice. Improved hygienic maintenance of head 2 is achieved by easier cleaning and faster drying of brushing structure 6, due to the absence of apertures in pad 8 or handle 4, and the absence of bristle clusters. This reduces the incidence of user re-infection following an episode of infectious illness. The structure including toothbrush head 2 and handle 4 may be microwaved to sterilize the device by eliminating germs.

This invention has been described with reference to the preferred embodiment. Variations and modifications can be made without departing from the scope of the present invention. For example, the projections may be constructed having a hollow center with closed top for increased flexibility. Additionally, a hollow projection may be employed to hold and release a chemical agent. The beveled projections may be arranged on a circular head with or without a central port such that the beveled cylindrical projections are positioned around the perimeter of the circular head. An interchangeable head of any shape or configuration could be employed. The configuration of conical and cylindrical projections may be altered. The present invention is limited only by the following claims.

What is claimed is:

1. A device for cleaning and polishing teeth, comprising:

a head having a pad;

a plurality of projections projecting outwardly from and being integral with said pad, said projections disposed generally parallel to each other;

a first portion of said projections comprising cylinders that are arranged in cooperating pairs, each cylinder being truncated and having one only beveled surface distal to said pad each cooperating cylinder pair being oriented such that said beveled surfaces of adjacent cylinders are positioned in facing relationship with each other, wherein facing beveled surfaces can come into contact with one another such that each cylinder pair can cooperatively form a pointed end for penetrating interproximal areas of the teeth; and a second portion of said projections having a conical configuration, said second portion of projections surrounding said first portion of projections.

2. The device as defined in claim 1 whereby said integral projections are constructed of a thermoplastic elastomer material.

3. The device as defined by claim 2 wherein said thermoplastic elastomer comprises an elastomeric alloy.

4. The device as defined by claim 3 wherein said elastomeric alloy comprises a polyolefin plastic and thermoset rubber.

5. The device as defined by claim 4 wherein said elastomeric alloy comprises a polypropylene plastic and EPDM rubber.

6. The device as defined in claim 1 wherein said head includes an upper surface, a bottom surface and side surfaces, said pad extending over said upper surface and beyond said side surfaces to form a bumper that protects the user's gums during brushing, said bottom and side surfaces being exposed.

7. A device for cleaning and polishing tooth enamel and cementum, comprising:

a head having a pad; and a plurality of generally parallel cylinders, each cylinder projecting outwardly from said pad and having only one beveled surface distal to said pad, said cylinders being arranged in pairs oriented such that the beveled surfaces of each said pair are positioned in facing relationship with each other, whereby facing beveled surfaces can come into contact with one another such that each cylinder, pair can cooperatively form a pointed end for penetrating interproximal areas of the teeth.

* * * * *

UNITED STATES PATENT AND TRADEMARK OFFICE

CERTIFICATE OF CORRECTION

PATENT NO. : 5,040,260

DATED : Aug. 20, 1991

INVENTOR(S) : George G. Michaels

It is certified that error appears in the above-identified patent and that said Letters Patent is hereby corrected as shown below:

Col. 4, line 35, between the words "ends" and "of", insert the reference numeral --18--

Col. 6, line 13, delete the words "one only" and substitute therefor the words --only one--

Col. 6, line 17, delete the word "wherein" and substitute therefor the word --whereby--

Col. 6, line 25, delete the word "in" and substitute therefor the word --by--

Col. 6, line 25, delete the word "whereby" and substitute therefor the word --wherein--

Col. 6, line 36, delete the word "in" and substitute therefor the word --by--

Col. 6, line 53, after the word "cylinder", delete the comma

Signed and Sealed this

Nineteenth Day of January, 1993

*Attest:*

DOUGLAS B. COMER

*Attesting Officer*

*Acting Commissioner of Patents and Trademarks*